United States Patent [19]

Hulscher

[11] 4,182,452

[45] Jan. 8, 1980

[54] METHOD FOR SORTING COPS, AND SPINTUBES USED THEREIN

[75] Inventor: Rudolf A. Hulscher, Hengelo, Netherlands

[73] Assignee: Three Parks Limited, St. Helier, Channel Islands

[21] Appl. No.: 785,756

[22] Filed: Apr. 7, 1977

[30] Foreign Application Priority Data

Apr. 8, 1976 [NL] Netherlands ..... 7603705

[51] Int. Cl.[2] ..... B07C 5/344

[52] U.S. Cl. ..... 209/569; 209/927

[58] Field of Search ..... 209/73, 74, 111.5, 111.6, 209/111.7, 111.8, 81, 81 A, 569, 927; 28/19, 20, 21

[56] References Cited

U.S. PATENT DOCUMENTS

| | | | |
|---|---|---|---|
| 3,021,949 | 2/1962 | Hogg et al. | 209/111.8 |
| 3,033,367 | 5/1962 | Gumpertz | 209/111.8 |
| 3,307,694 | 3/1967 | Selwood et al. | 209/90 X |
| 3,563,376 | 2/1971 | Zegna | 209/81 R |
| 4,050,010 | 9/1977 | Isnard | 209/111.8 |

*Primary Examiner*—Allen N. Knowles

*Attorney, Agent, or Firm*—Haseltine, Lake & Waters

[57] ABSTRACT

An arrangement for sorting cops in which the latter are provided with premarked spintubes and are guided past a detection system which registers the presence or absence of detection rings on the premarked spintubes in the form of signals. Cops which do not satisfy a required pattern of marks, are rejected. The spintubes are provided with detection rings of a material which is different from that of the tube itself. The detection rings may also be of a different material thickness than the remainder of the spintube. The detection rings, moreover, may be made of metal, and a magnetic field or a high-frequency signal may be used in conjunction with the detection system. The metal may be in the form of iron, copper or aluminum.

13 Claims, 3 Drawing Figures

METHOD FOR SORTING COPS, AND SPINTUBES USED THEREIN

BACKGROUND OF THE INVENTION

The present invention relates to a method for sorting cops and spintubes used therein.

Until now it has been customary to distinguish between yarn counts visually by observing the color of the spintube. As a consequence of the continuing mechanization of the spinning and winding operations, visual recognition of tubes is no longer practical as cops are no longer positioned manually on the winding machine, but are dumped into a container, from where they are transported automatically to their positions on the winding machine. Furthermore there are more different yarn counts than there are spintubes which differ distinguishably. In this connection it should be observed that when a cop is full, only the extreme ends of the spintube are visible. (Cops are spintubes covered with yarn.)

There is a risk that a different yarn count is present among a batch of cops with a certain count and this may result in considerable economic losses, since one wrong cop, usually containing some 3000 meters of yarn in one batch, may ruin one cone (or cheese) on which the yarn of usually 10 to 15 cops has been wound. In its turn one wrong cone, when used for weft, may ruin one or two meters of cloth and when used for warp may ruin even hundreds to thousands of meters of cloth.

It has now been found in accordance with the present invention, that the above-described difficulties may be overcome by detecting the cops by electronic means, using a distinctive signal pattern formed by the individual spintubes.

It is an object of the present invention, therefore, to provide an arrangement of the foregoing character which is simple in construction and may be economically fabricated.

A further object of the present invention is to provide an arrangement, as described, which may be readily maintained in service, and which has a substantially long operating life.

SUMMARY OF THE INVENTION

The objects of the present invention are achieved by providing a method for sorting cops with the characteristic feature that cops with premarked spintubes are guided past a detection system that registers by physical means the presence or absence of marks on the premarked spintubes in the form of signals, and ejects those cops which do not satisfy the required pattern of marks. The ejection is carried out in a conventional manner.

By using a distinctive spintube for each yarn count, every wrong cop can be recognized and removed. Different systems, suitable for measuring, e.g., changes in a magnetic field, changes in capacity, or the reflection or interruption of a signal of high frequency, as is further described hereinafter, may be used for detection. It is obvious that the choice of the materials used is dictated by the sensitivity of the detectors. In essence each change of the homogeneity of the objects in the range of observation is measurable. Such a change may consist of removing or adding to the material of the spintube at the measuring level a different material, e.g., a metal, a non-metal, or a change may consist of a variation in the dimension of the material such as a thickening, thinning, or even an opening introduced at the detector level. By arranging the cops in a row and guiding them past the detection system, they can be recognized by their detection marks. Depending on the number of yarn counts to be distinguished from each other, the tube can be equipped with a number of detection marks at different levels, corresponding with the levels of the different detectors. The recognition of the cops with the detection system is carried out in the same manner as for the spintubes. The system described above may also be used for cones, if this would be required for practical reasons.

For a more detailed explanation of the invention reference, for example, is made to a cop the spintube of which is equipped with 4 detection marks. With one position being used as a permanent position to ascertain the presence of a marked spintube, it is possible to distinguish between eight different yarns depending on positions on the marked spintube as well as the sequency thereof. It is obvious that by increasing the number of detection marks, the number of different possible combinations is increased, and thus any desired number of yarns may be distinguished by adding additional detection marks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
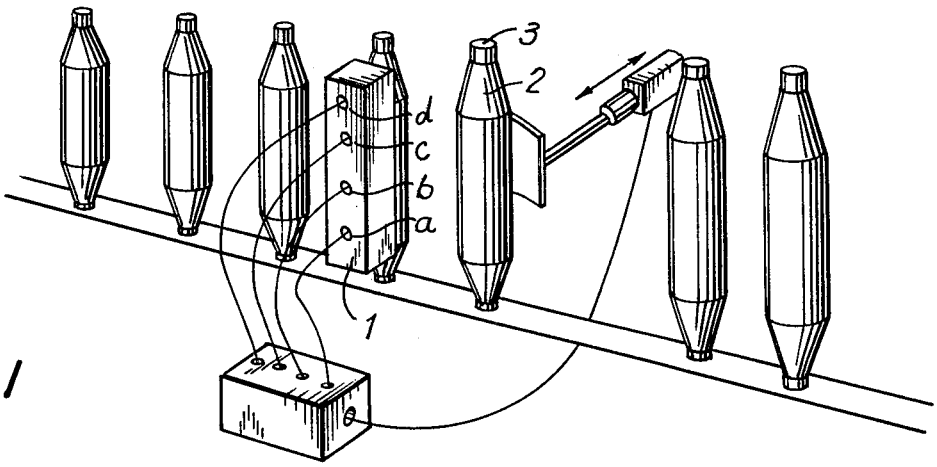
FIG. 1 is a perspective view and shows cops moving with predetermined velocity along a detector bench, in accordance with the present invention.

FIG. 1 shows a detector bench 1, with cops moving by at a certain velocity; in this case with a velocity of 30 per minute. The cops 2 are guided past the detectors a, b, c and d. The spintubes 3 are equipped with detection rings suitable for the particular detection system used at the level of the respective detectors. An appropriate energy source is mounted opposite the detectors a, b, c and d. Depending on the coverage of the spintube, a signal will be received by the detectors. By pre-setting the detector bench in a particular pattern, e.g., coverage of positions a, b and d on the spintubes, deviating spintubes and cops can be ejected or in some other way be removed from the system.

Figure 2:
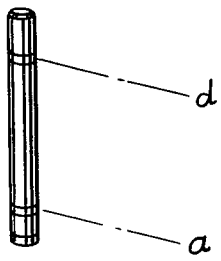
FIG. 2 is a perspective view and shows the arrangement of a cop with detection rings.
Figure 3:
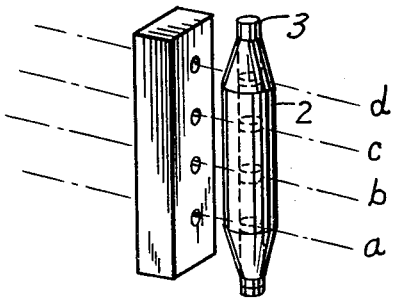
FIG. 3 is a perspective view and shows the arrangement of a cop provided with four detection rings in relation to a detection system.

The cops 2 are fitted out as shown in FIG. 2, e.g., equipped with two detection rings a and d, or for example, as represented in FIG. 3 with four detection rings a, b, c and d. A deviating spintube structure can be detected by various means. It can be done by changes in a magnetic field, changes in capacity or reflection or interruption of a signal of high frequency, or other signals may be used. When changes in the magnetic field of the capacity are to be measured, the detection ring usually consists of iron, copper or aluminum, but other metals or alloys, which cause a change in the magnetic field or the capacity, may also be used.

Since wrong cops are ejected in some known manner when the above method is used, only cops with the proper yarn count will end up on the cones (or cheeses), the cones usually being wound simultaneously in large numbers. In this way material is not wasted unnecessarily by using a wrong cop in winding the cones, or by using a wrong cone or at least a partially faulty cone, for the production of cloth.

When using high-frequency signals for detection the detection rings may consist of one of the above mentioned metals or another reflecting material.

The invention also relates to the spintubes used in the method according to the invention. The spintubes are provided with one or more detection rings, consisting of a modification of the nature and/or the thickness of the material of the tube. Suitable materials for the detection rings are, as mentioned earlier, metals such as iron, copper and aluminum, and nonmetals, such as glass or plastic. The detection ring may also consist of a greater or lesser amount of the material used in the spintube itself. The choice of the material of the detection rings depends of course on the chosen detection method; thus in the case of a magnetic field a suitable metal will be used, such as described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A method for sorting cops comprising the steps of: guiding cops with premarked spintubes past a detection system, said cops comprising spintubes including their markings being covered with yarn; registering by physical means the presence or absence of yarn covered detection rings on the premarked spintubes and transmitting signals indicative of the presence or absence of said detection rings; and ejecting cops not satisfying a required pattern of marks.

2. A method as defined in claim 1 wherein said spintubes have detection rings comprised of material different from the material of the spintubes.

3. A method as defined in claim 1 wherein said spintubes have detection rings with material thickness different from the thickness of the remainder of the spintubes.

4. A method as defined in claim 1 including the step of using spintubes with detection rings of metal substantially fully covered with yarn; and applying a magnetic field in conjunction with said detection system.

5. A method as defined in claim 1 including the step of using spintubes with detection rings of metal substantially fully covered with yarn; and applying a high-frequency signal in conjunction with said detection system.

6. A spintube with a least one detection ring having a material with property deviating from a corresponding property of the material of the spintube, said detection ring being substantially fully covered with yarn, said detection ring being detectable by physical means in the form of signals transmitted through the yarn.

7. Spintube according to claim 6 and having at least one detection ring wherein one the detection ring comprises a modification of the nature and/or thickness of the material of the spintube.

8. Spintube according to claim 7, wherein the detection ring comprises a non-metal.

9. Spintube according to claim 7, wherein the detection ring comprises a metal.

10. Spintube according to claim 9, wherein the metal is iron, copper or aluminum.

11. Spintube according to claim 7, wherein the detection comprises an increase or decrease of the material of the spintube itself.

12. A method for sorting cops comprising the steps of: guiding cops with premarked spintubes past a detection system, said cops comprising spintubes covered with yarn; registering by physical means the presence or absence of detection rings on the premarked spintubes and transmitting signals indicative of the presence or absence of said detection rings; and ejecting cops not satisfying a required pattern of marks, said spintubes comprising further a selected number of detection rings, said registering step detecting positions of said detecting rings independent of spacing between said detection ring, said detection rings being located below the outer surface of said spintubes, said detection rings being arranged according to a specific code.

13. A spintube with at least one detection ring having a material with property deviating from a corresponding property of the material of the spintube, said spintube comprising further a selected number of detection rings, said detection ring being detected by the position of said detection rings independent of spacing between said detection rings, said detection rings being located below the outer surface of said spintube, said detection ring being arranged according to a specific code.

* * * * *